US006605571B1

(12) United States Patent
Higton et al.

(10) Patent No.: US 6,605,571 B1
(45) Date of Patent: Aug. 12, 2003

(54) OLEAGINOUS CONCENTRATES

(75) Inventors: Gary Higton, Oxford (GB); Roger Glyde, Bampton (GB); Robert A. Wilkinson, Newbury (GB)

(73) Assignee: Exxon Chemical Patents Inc.

( * ) Notice: Subject to any disclaimer, the term of this patent is extended or adjusted under 35 U.S.C. 154(b) by 0 days.

(21) Appl. No.: 09/285,921

(22) Filed: Apr. 2, 1999

(30) Foreign Application Priority Data

Apr. 9, 1998 (GB) ..... 9807729

(51) Int. Cl.[7] ..... C10M 161/00

(52) U.S. Cl. ..... 508/185; 508/192; 508/287; 508/371; 508/372; 508/373; 508/375

(58) Field of Search ..... 508/185, 192, 508/371

(56) References Cited

U.S. PATENT DOCUMENTS 4,487,704 A 12/1984 Yamaguchi et al. ..... 252/33.4
5,128,056 A * 7/1992 Gutierrez et al. ..... 252/51.5 A
5,200,103 A * 4/1993 Song et al. ..... 252/51.5 R

FOREIGN PATENT DOCUMENTS

| | | |
|---|---|---|
| EP | 294 096 | 12/1988 |
| EP | 516 461 A1 | 12/1992 |
| WO | WO 95/29976 | 11/1995 |

* cited by examiner

*Primary Examiner*—Ellen M. McAvoy

(57) ABSTRACT

Concentrates for lubricating oil compositions are prepared by blending at elevated temperature:

(A) at least one high molecular weight ashless dispersant; and (B) at least one oil-soluble metal detergent; in the presence of (C) at least one metal salt of a dihydrocarbylphosphorodithoic acid wherein the metal of the metal salt is an alkali metal, an alkaline earth metal, or zinc, aluminium, lead, tin, molybdenum, manganese, nickel or copper.

13 Claims, No Drawings

OLEAGINOUS CONCENTRATES

This invention relates to oleaginous concentrates suitable for lubricating oil compositions and a process for their preparation.

In the preparation of lubricating oil compositions it is common practice to introduce additives therefor in the form of 10 to 80, e.g. 20 to 80, mass % active ingredient concentrates in hydrocarbon oil, e.g. mineral lubricating oil, or other suitable solvent. Usually these concentrates are subsequently diluted with 3 to 100, e.g. 5 to 40, parts by weight of lubricating oil per part by weight of the concentrate to form finished lubricating oil compositions, e.g. crankcase motor oils (or lubricants).

The purpose of concentrates is to improve the handling of the various materials as well as to facilitate solution or dispersion in the finished composition. Ordinarily, when preparing a lubricating oil composition that contains several types of additive (sometimes referred to as "additive components"), problems do not arise where each additive is incorporated separately, each in the form of a concentrate in oil. In many instances, however, it is convenient to provide a so-called additive "package" (also referred to as an "adpack") comprising two or more additives in a single concentrate in a hydrocarbon oil or other suitable solvent. Some additives tend to react with each other in an adpack: dispersants having a high functionality (ratio), for example, of 1.3 or higher, have been found to interact with other additives in adpacks, particularly overbased metal detergents, to cause a viscosity increase upon blending to form an adpack, which may be followed by a subsequent growth or increase of viscosity with time, in some instances resulting in gelation. This viscosity increase can hamper pumping, blending and handling of the adpack. Although the adpack can be further diluted with more diluent oil to reduce viscosity in order to offset the effect of interaction, dilution reduces the economy of using an adpack by increasing shipping, storage and other handling costs.

EP-A-0,294,096 describes a process for improving the stability of oleaginous concentrates in the form of adpacks comprising high molecular weight ashless dispersants in combination with metal detergents in which the additives are contacted in a lubricating oil basestock at a temperature of from 100 to 160° C. for 1 to 10 hours. The resultant heat-treated blend is then cooled to a temperature of 85° C. or below and further mixed with copper antoxidant additives, zinc dihydrocarbyldithiophosphate antiwear additives and, optionally, other additives useful in lubricating oil compositions. The process enables the stability of the adpack to be improved to the extent that the tendency for phase separation is substantially reduced or prevented, offsetting, or eliminating the need for using auxiliary stabilisers to achieve a required degree of stability. EP-A0,294,096 indicates that the stability problem is more severe the higher the molecular weight of the ashless dispersant and that a substantial increase in viscosity can occur upon blending high molecular weight dispersants, particularly those having a high degree of functionality, with other additives, such as overbased metal detergents.

Thus, a problem in the process of EP-A-294,096 is that, when using high molecular weight dispersants, viscosity may rise and may rise uncontrollably to the extent that a gel may form which is impossible to blend into a finished (or final) lubricating oil composition. The above effect can evidence itself as the Weissenberg effect, wherein material contained therein will become impossible to handle in conventional blending equipment.

DETAILED DESCRIPTION

The present invention solves the problem by admixing a metal salt of a P- and/or S-containing acid with the dispersant and detergent.

Thus, one aspect of the invention is a process for preparing an oleaginous concentrate suitable for a lubricating oil composition comprising blending at elevated temperature additive components (A) and (B) in the presence of additive component (C), wherein (A) is at least one high molecular weight ashless dispersant comprising an oil-soluble polymeric hydrocarbon backbone of number average molecular weight of 1,500 or greater, such as between 2,000 and 4,000, having functional groups; (B) is at least one oil-soluble metal detergent; and (C) is at least one oil-soluble metal salt of a phosphorus- and/or sulphur-containing acid such as a dihydrocarbylphosphorodithoic acid, wherein the metal of the salt is an alkali metal (e.g. sodium or potassium), an alkaline earth metal (e.g. magnesium or calcium), or zinc, aluminium, lead, tin, molybdenum, manganese, nickel or copper.

It has been found that the inclusion of the metal salt enables the viscosity of the concentrate to be controlled within manageable limits; inclusion of the metal salt gives a very significant reduction in viscosity compared with the same blend lacking the metal salt. The invention enables a concentrate, in the form of an adpack, comprising a high molecular weight ashless dispersant and a metal detergent to be prepared without encountering a viscosity rise which is so excessive as to make subsequent handling, and the addition of further additives to the concentrate, difficult. The inclusion of the metal salt enables viscosity to be controlled at a level which permits the ready addition of further additives and results in a concentrate of manageable viscosity.

The additives, as components of the concentrate, may be blended in any order, conveniently by stirring in a mixing vessel. Since the dispersant is usually the largest volume component, such as 25 to 50% of the concentrate, it is usually charged to cover the stirrer to facilitate blending. The detergent may be added next, but the dispersant is preferably contacted with the metal salt before it is contacted with the metal detergent.

The preparation of concentrates according to the invention is, as stated, effected at an elevated temperature, i.e. at above ambient temperature. It is preferably effected at at least 50, such as at least 80° C. Although energy is saved at low temperatures, practical considerations dictate the most convenient temperature that can be used. Thus, where any additive is used that is solid at ambient temperature, it is usually more convenient to raise its temperature to that at which it flows rather than dissolving it in oil before blending it with the other additives. Temperatures of 100° C. or more can be employed if any additive is more conveniently handled at such temperatures. Consideration must be given to the time for which it is held at the blending temperature and its stability under such temperatures and time conditions.

In order for the concentrate to be oleaginous, the additives may be in solution in an oleaginous carrier or such a carrier may be provided separately or both. Examples of suitable carriers are oils of lubricating viscosity, such as described in detail hereinafter, and aliphatic, naphthenic and aromatic hydrocarbons.

Components (A), (B) and (C) must be "oil-soluble" or "oil-dispersible" in the oleaginous carrier or oil of lubricating viscosity, but these do not mean that they are soluble, dissolvable, miscible or capable of being suspended in the oil in all proportions. They do mean, however, that (A), (B) and (C) are, for instance, soluble or stable dispersible in the oil to an extent sufficient to exert their intended effect in the environment in which be lubricating oil composition is employed. Moreover, the additional incorporation of other additives such as those described hereinafter may affect the oil-solubility or -dispersability of one or any combination of (A), (B) and (C).

It should be appreciated that interaction may take place between the additive components of the invention after they have been blended, in either the process of blending or any subsequent condition to which the concentrate is exposed, including the use of a lubricating oil composition incorporating the concentrate in its working environment. Interactions may also take place when further auxiliary additives are added to the concentrates of the invention. Such interaction may include interaction which alters the chemical constitution of any of the additives. Thus, the concentrates of the invention include concentrates in which interaction between any of the additive components has occurred, as well as concentrates in which no interaction has occurred between the components that are blended.

The components are advantageously held at the blending temperature for a time sufficient to achieve a homogenous blend thereof. This can usually be effected within ½ hr, particularly when the blending temperature exceeds 80° C.

One or more further lubricating oil additives, desirable for conferring a full range of properties on the oleaginous composite, may be added thereto. The temperature at which these further additives are added will depend on the stability of the particular additives. Preferably any blending of further additives is effected at temperatures of not greater than 85° C.

The concentrates of the invention can be incorporated into a lubricating oil composition in any convenient way. Thus, they can be added directly to an oil of lubricating viscosity by dispersing or dissolving the same in the oil at the desired level of concentrations of the dispersant and detergent, respectively. Such blending can occur at ambient temperature or elevated temperatures. Alternatively, the concentrate can be blended with a suitable oil-soluble solvent or base oil to form a further concentrate which is then blended with an oil of lubricating viscosity to obtain the final lubricating oil composition. Such concentrate will typically contain (on an active ingredient (A.I.) basis) from 10 to 50, preferably from 10 to 35, mass % dispersant additive; from 2 to 30, preferably from 5 to 30, mass % metal detergent additive; and typically from 20 to 80, preferably from 40 to 60, mass % diluent oil, based on the mass of the concentrate. The metal salt may be present in the concentrate at from 1.5 to 15, preferably 1.5 to 10, mass % based on the mass of the concentrate. Such concentrate will typically contain (on an active ingredient basis) dispersant and detergent in a dispersant:detergent mass:mass ratio of from about 0.25:1 to 5:1, preferably from about 0.5:1 to 4.5:1, and more typically from about 0.1:1 to 4:1.

A second aspect of the invention is an oleaginous concentrate suitable for a lubricating oil composition comprising a blend of:

10 to 50 mass % of ashless dispersant (A);

2 to 30 mass % of metal detergent (B);

1.5 to 15 mass % of of metal salt (C); and diluent oil, wherein (A), (B) and (C) are defined as in the first aspect of the invention, the kinematic viscosity of the concentrate is less than 1000, such as less than 700, preferably 300 to 600, $mm^2s^{-1}$ at 100° C., and the sum of the concentrations of (A) and (B) in the concentrate is 25 to 75, preferably 40 to 50, mass %. Such a concentrate, because of its properties, facilities production of complex lubricating oil compositions therefrom.

The features of the invention will now be discussed in further detail as follows:

Component (A): Ashless Dispersants

The high molecular weight ashless dispersants of the concentrates of the invention include the range of ashless dispersants known as effective for adding to lubricant oils for the purpose of reducing the formation of deposits in gasoline or diesel engines. By "high molecular weight" is meant that the polymeric hydrocarbon backbone has a number average molecular weight of 1500 or greater such as between 2,000 and 5,000, preferably 2,000 to 4,000. A wide variety of such compounds is available, as now described in more detail.

The ashless dispersant comprises an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

A class of ashless dispersants comprising ethylene alpha-olefin copolymers and alphalefin homo- and copolymers prepared using metallocene catalyst chemistry, which may have a high degree (e.g. >30%) of terminal vinylidene unsaturation is described In U.S. Pat. Nos. 5,128,056, 5,151,204, 5,200,103, 5,225,092, 5,266,223, 5,334,775; WO-A-94/19436, 94/13709; and EP-A-440506, 513157, 513211. These dispersants are described as having superior viscometric properties as expressed in a ratio of CCS viscosity to kV 100° C.

The term "alph-olefin" is used herein to denote an olefin of the formula

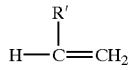

wherein R' is preferably a $C_1$–$C_{18}$ alkyl group. The requirement for terminal vinylidene unsaturation refers to the presence in the polymer of the following structure:

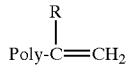

wherein Poly is the polymer chain and R is typically a $C_1$–$C_{18}$ alkyl group, typically methyl or ethyl. Preferably the polymers will have at least 50%, and most preferably at least 60%, of the polymer chains with terminal vinylidene unsaturation. As indicated in WO-A-94/19426, ethylene/1-butene copolymers typically have vinyl groups terminating no more than about 10 percent of the chains, and, internal mono-unsaturation in the balance of the chains. The nature of the unsaturation may be determined by FTIR spectroscopic analysis, titration or C-13 NMR.

The oil-soluble polymeric hydrocarbon backbone may be a homopolymer (e.g., polypropylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, e.g., 1 to 10 mole %, is an α,ω-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene). Atactic propylene oligomers typically having an $\overline{Mn}$ of from 700 to 5000 may also be used, as described in EP-A-490454, as well as heteropolymers such as polyepoxides.

One preferred class of olefin polymers is polybutenes and specifically poly-n-butenes, such as may be prepared by polymerisation of a $C_4$ refinery stream. Other preferred classes of olefin polymers are EAO copolymers that preferably contain 1 to 50 mole % ethylene, and more preferably 5 to 48 mole % ethylene. Such polymers may contain more than one alpha-olefin and may contain one or more $C_3$ to $C_{22}$ diolefins. Also useable are mixtures of EAO's of varying ethylene content. Different polymer types, e.g., EAO, may also be mixed or blended, as well as polymers differing in $\overline{Mn}$; components derived from these also may be mixed or blended.

Polymer molecular weight, specifically $\overline{Mn}$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method, particularly for lower molecular weight polymers, is vapor pressure osmometry (see, e.g., ASTM D3592).

The degree of polymerisation $D_p$ of a polymer is:

$$D_p = \sum_i \frac{\text{Mn} \times \text{mol. \% monomer } i}{100 \times \text{mol. wt monomer } i}$$

and thus for the copolymers of two monomers $D_p$ may be calculated as follows:

$$D_p = \frac{\text{Mn} \times \text{mol. \% monomer 1}}{100 \times \text{mol. wt monomer 1}} + \frac{\text{Mn} \times \text{mol. \% monomer 2}}{100 \times \text{mol. wt monomer 2}}$$

Preferably, the degree of polymerisation for the polymer backbones used in the invention is at least 45, typically from 50 to 165, more preferably 55 to 140.

Particularly preferred copolymers are ethylene butene copolymers.

Preferably, the olefin polymers and copolymers may be prepared by various catalytic polymerisation processes using metallocene catalysts which are, for example, bulky ligand transition metal compounds of the formula:

$$[L]_m M[A]_n$$

where L is a bulky ligand; A is a leaving group, M is a transition metal, and m and n are such that the total ligand valency corresponds to the transition metal valency. Preferably the catalyst is four coordinate such that the compound is ionizable to a $1^+$ valency state.

The ligands L and A may be bridged to each other, and if two ligands A and/or L are present, they may be bridged. The metallocene compound may be a full sandwich compound having two or more ligands L which may be cyclopentadienyl ligands or cyclopentadienyl derived ligands, or they may be half sandwich compounds having one such ligand L. The ligand may be mono- or polynuclear or any other ligand capable of η-5 bonding to the transition metal.

One or more of the ligands may π-bond to the transition metal atom, which may be a Group 4, 5 or 6 transition metal and/or a lanthanide or actinide transition metal, with zirconium, titanium and hafnium being particularly preferred.

The ligands may be substituted or unsubstituted, and mono-, di-, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorus or nitrogen atom-containing radical, and preferably the bridge places a one-atom link between the entities being bridged, although that atom may and often does carry other substituents.

The metallocene may also contain a further displaceable ligand, preferably displaced by a cocatalyst—a leaving group—that is usually selected from a wide variety of hydrocarbyl groups and halogens.

Such polymerisations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 277004, 420436, 520732; and WO-A-91/04257, 92/00333, 93/08199, 93/08221, 94/07928 and 94/13716.

The oil-soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil-soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil-soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitrites, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl)cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. Nos. 4,234,435 and 5,229,022.

The functionalized oil-soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding ashless dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be diesters of succinic acids or acidic esters, i.e., partially esterified succinic acids, as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

Examples of functionalized and/or derivatized olefin polymers based on polymers synthesized using metallocene catalyst systems are described in publications identified above.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the cylated nitrogen composition. Usefully the dispersants contain from about 0.05 to 2.0 wt. %, e.g. 0.05 to 0.7 wt. % boron based on the total weight of the borated acyl nitrogen compound. The boron, which appears be in the product as dehydrated boric acid polymers (primarily $(HBO_2)_3$), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the dicarboxylic acid material and amine while removing water.

Also, boron may be provided separately, for example as a boron ester or as a boron succinimide, made for example from a polylsobutylene succinic anhydride, where the polymer has a molecular weight of from 450 to 700.

Preferred ashless dispersants are the functionalised and derivatised olefin polymers based on ethylene alpha-olefin polymers previously described, produced using metallocene catalyst systems.

Component (B): Oil-Soluble Metal Detergent

Metal-containing or ash-forming detergents function both as detergents to reduce or remove deposits and as acid neutraliziers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralised detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaqphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil-soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Component (C): Metal Salts

Examples of salts are mono- or dihydrocarbyldithiophosphates, thioxanthates, dihydrocarbylphosphates, dihydrocarbyidithiocarbamates, and dihydrocarbylphosphorodithoates, the latter being preferred.

"Hydrocarbyl" denotes a substituent having a carbon atom attached directly to the remainder of the anion and may contain hetero atoms, i.e. other than C and H, provided they do not detract from the hydrocarbyl character of the substituent. As stated, the metal salts used to control the viscosity of the blend may be alkali or alkaline earth metal salts, or may be zinc, aluminium, lead, tin, molybdenum, manganese, nickel or copper salts. Zinc salts are preferred as they are commonly used for the purpose of conferring anti-wear or antioxidant properties on lubricating oils. They may be prepared in accordance with known techniques by first forming a dihydrocarbylphosphorodithoic acid, usually by reaction of one or more alcohol or a phenol with $P_2S_5$, and then neutralising the formed acid with a zinc compound. For example, a phosphorodithoic acid may be made by reacting mixtures of primary and secondary alcohols. Alternatively, multiple phosphorodithoic acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil-soluble salts of dihydrocarbylphosphorodithoic acids represented by the general formula $[(RO)R'O)P(S)S]_2Zn$ wherein R and R', which may be the same or different, are hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred are alkyl groups of 2 to 8 carbon atoms, Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms in the dithiophosphoric acid will generally be 5 or greater. The zinc dihydrocarbyl phosphorodithoate can therefore comprise zinc dialkyl dithiophosphates.

Oil of Lubricating Viscocity

Oil of lubricating viscosity, useful as a diluent oil for making concentrates of the invention or for making lubricating oil compositions therefrom, may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil, and heavy duty diesel oil. Generally, the viscosity of the oil ranges from 2 to 30, especially 5 to 20, $mm^2s^{-1}$ at 100° C.

Natural oils include animal oils and vegetable oils (e.g., castor, lard oil) liquid petroleum oils and hydrorefined, solvent-treated or acid-treated mineral lubricating oils of the paraffinic, napthenic and mixed paraffinic-napthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexanes), poly(1-octenes), poly (1-decenes)); alkylbenzenes (e.g., dodecylbenzenes, tetradecylbenzenes, dinonylbenzenes, di(2-ethylhexyl) benzenes); polyphenyls (e.g., biphenyls, terphenyls, alkylated polyphenols); and alkylated diphenyl ethers and alkylated diphenyl sulfides and the derivatives; analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., to methylpolyisopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, subericacid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethythexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, dilsooctyl azelate, disodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to C12 monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyakoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetrap-tert-butyl-phenyl)silicate, hexa-(4-methyl-2-pentoxy) disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Other Additive Components

Additional additives may be incorporated in the concentrates of the invention to enable them to meet particular requirements. Examples of such additives are viscosity index improvers, corrosion inhibitors, other oxidation inhibitors, friction modifiers, other dispersants, anti-foaming agents, anti-wear agents, pour point depressants, and rust inhibitors. Some are discussed in further detail below.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Examples of supplementary antioxidants include, for example, aromatic amines, for example alkylated phenylamines and phenyl α-naphthylamine; hindered phenols; alkaline earth metal salts of sulphurized alkyl-phenols having preferably $C_5$ to $C_{12}$ alkyl side chains, e.g., calcium nonylphenyl sulphide; barium octylphenyl sulphide; hindered phenols; phosphosulphurized or sulphurized hydrocarbons; and oil-soluble copper compounds.

Friction modifiers and fuel economy agents which are compatible with the other ingredients of the final oil may also be included. Examples of such materials are glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Viscosity index improver dispersants function both as viscosity index improvers and as dispersants. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Examples of dispersants and viscosity index improver dispersants may be found in European Patent Specification No. 24146 B.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

It may be necessary to include an additive which maintains the stability of the viscosity of the concentrates of the invention. Additives which are effective in controlling this viscosity increase include the long chain hydrocarbons functionalised by reaction with mono- or dicarboxylic acids or anhydrides which are used in the preparation of the ashless dispersants as hereinbefore disclosed. Typically suitable for this purpose are polyisobutylenes reacted with maleic anhydrides.

As indicated earlier, it may be desirable, although not essential, in addition to the concentrate of the invention, to prepare one or more additive concentrates comprising additives whereby several additives can be added simultaneously to the oil to form a lubricating oil composition.

The final composition may employ from 5 to 25, preferably 5 to 18, typically 10 to 15, mass % of the concentrate, the remainder being oil of lubricating viscosity.

The lubricating oil compositions may be used to lubricate mechanical engine components, particularly of an internal combustion engine such as a spark-ignited or compression-ignited engine, by adding the composition thereto.

The components of the compositions, essential as well as optional and customary, may react under conditions of blending or formulation, storage, or use; the invention also provides the product obtainable or obtained as a result of any such reaction.

When preparing lubricating oil compositions containing one or more of the above-mentioned additives, each additive is typically blended into a base oil in an amount which enables the additive to provide its desired function. Representative effect amounts of such additives, when used in crankcase lubricants, are listed below, which may include additives defined in aspects of this invention.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Antioxidant | 0–5 | 0.01–2 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |
| Viscosity Modifier | 0.01–10 | 0.25–3 |
| Basestock | Balance | Balance |

All weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

The words "comprises" or "comprising" or cognate words when used in this specification are taken to specify the presence of stated features, integers, steps or components, but do not preclude the presence or addition of one or more other features, integers, steps, components or groups thereof.

EXAMPLES

This invention will be further understood by reference to the following examples, wherein all parts are parts by mass, unless otherwise noted.

In the following examples, oleaginous additive concentrates suitable for use in making lubricating oil compositions were made from the following components.

(A) High Molecular Weight Ashless Dispersant

A1: an unborated ashless dispersant prepared from an ethene-butene copolymer (Mn=3,250; ethene content=46%; terminal vinylidene content=66%) that is functionalised by a carbonyl group introduced by the Koch reaction and subsequently aminated, as described in WO-A-94/13709. The dispersant is used at 50% active ingredient.

(B) Oil-Soluble Metal Detergent

B1: overbased magnesium alkylated sulfonate of Total Base Number (TBN) 400, the alkyl group being derived from poly(n-butene).

B2: overbased calcium alkyated sulfonate of Total Base Number (TBN) 300, the alkyl group being derived from poly(n-butene).

(C) Metal Salt of Acid

C1: zinc dialkyldithiophosphate, wherein the alkyl groups are sec-$C_6$, made from 4-methylpentan-2-ol.

An oleaginous carrier in the form of a diluent mineral oil (solvent neutral 150) was also used, and is referred to as "diluent".

The general procedure comprised blending a component (A) with a component (C) and diluent at 95° C. for 3 hours, and then blending the resulting blend with a component (B) at 70° C. for 1 hour. The kinematic viscosity of the final blend was measured at 100° C.

By way of comparison, the general procedure was repeated, but omitting the step of blending with a component (C).

The results are summarised in Table I below where examples of the invention are indicated by numbers and comparison examples by letters.

COMPONENTS

| Example | A1 | B1 | B2 | C1 | Diluent | Viscosity |
|---|---|---|---|---|---|---|
| 1 | 53.5 | 15.5 | | 16.9 | 14.1 | 308 |
| Z | 53.5 | 15.5 | | | 31.0 | 606 |
| 2 | 62.3 | 18.0 | | 6.4 | 13.3 | 671 |
| 3 | 62.3 | 18.0 | | 3.2 | 16.5 | 991 |
| Y | 62.3 | 18.0 | | | 19.7 | 1,550 |
| 4 | 53.5 | | 15.5 | 16.9 | 14.1 | 267 |
| X | 53.5 | | 15.5 | | 31.0 | 1,036 |
| 5 | 62.3 | | 18.0 | 6.4 | 13.3 | 559 |
| 6 | 62.3 | | 18.0 | 3.2 | 16.5 | 688 |
| W | 62.3 | | 18.0 | | 19.7 | 2,397 |

Notes

In Table I:

numbers against indicated components are mass % of that component.

viscosity is kinematic viscosity in $mm^2 s^{-1}$, measured at 100° C.

comparisons are provided in groups of adjacent sets of data, wherein the total mass % of dispersant and detergent (A1 + B1 or A1 + B2) is kept constant and the total mass % of metal salt and diluent (C1 + the diluent) is kept constant.

The viscosity of C1 (c. 9 $mm^2s^{-1}$ at 100° C.) is greater than that of the diluent oil (5.1 $mm^2s^{-1}$ at 100° C.); it is therefore surprising that blends containing a greater mass % of C1 have a lower viscosity.

The results show that the presence of component C1 significantly reduces the viscosity of the blend, i.e. the viscosities of the blends of each of Examples 1 to 6 are significantly less than the viscosities of the corresponding blends of Examples W to Z.

What is claimed is:

1. A process for preparing an oleaginous concentrate suitable for a lubricating oil composition comprising blending at elevated temperature additive components (A) and (B) in the presence of additive component (C), wherein (A) is at least one high molecular weight ashless dispersant comprising an oil-soluble polymeric hydrocarbon backbone of number average molecular weight of 1,500 or greater having functional groups; (B) is at least one oil-soluble metal detergent; and (C) is at least one oil-soluble zinc salt of a phosphorus- and/or sulphur-containing acid.

2. The process as claimed in claim 1 wherein the elevated temperature is at least 50° C.

3. The process as claimed in claim 2 wherein the elevated temperature is at least 80° C.

4. The process as claimed in claim 1 wherein the zinc salt is blended with the ashless dispersant before blending with the metal detergent.

5. The process as claimed in claim 1 wherein the concentrate comprises 10 to 50 mass % of ashless dispersant, 2 to 30 mass % of metal detergent, 1.5 to 15 mass % of zinc salt and 20 to 80 mass % of diluent oil, all based on the weight of the concentrate.

6. The process as claimed in claim 1 wherein boron is provided in the concentrate.

7. The process as claimed in claim 6 wherein the boron is provided in the form of a borated ashless dispersant or in the form of an additional boron-containing compound or both.

8. The process as claimed in claim 1 wherein the backbone of the ashless dispersant (A) is derived from a polymer having greater than 30% terminal vinylidene unsaturation, being any ethylene alpha-olefin copolymer or alpha-olefin homo- or copolymer.

9. An oleaginous concentrate suitable for a lubricating oil composition comprising a blend of:

10 to 50 mass % of ashless dispersant (A);

2 to 30 mass % of metal detergent (B);

1.5 to 15 mass % of zinc salt (C); and diluent oil, wherein (A), (B) and (C) are defined as in claim 1, the kinematic viscosity of the concentrate is less than 1000

$mm^2s^{-1}$ at 100° C., and the sum of the concentrations of (A) and (B) in the concentrate is 25 to 75 mass %.

10. The process as claimed in claim 1 wherein the concentrate is subsequently blended with one or more further lubricating oil additives to form a composite.

11. The process as claimed in claim 10 comprising the further step of blending the composite into a lubricating oil composition.

12. The process as claimed in claim 1, wherein additive component (B) is an overbased metal detergent having a TBN of at least 150.

13. The oleaginous concentrate of claim 9, wherein additive component (B) is an overbased metal detergent having a TBN of at least 150.

* * * * *